US007291582B2

(12) United States Patent
Hsu et al.

(10) Patent No.: US 7,291,582 B2
(45) Date of Patent: Nov. 6, 2007

(54) LIQUID LAUNDRY DETERGENT WITH AN ALKOXYLATED ESTER SURFACTANT

(75) Inventors: Feng-lung Gordon Hsu, Tenafly, NJ (US); Shui-Ping Zhu, Fairfield, CT (US)

(73) Assignee: Conopco, Inc., d/b/a Unilever, Englewood Cliffs, NJ (US)

( * ) Notice: Subject to any disclaimer, the term of this patent is extended or adjusted under 35 U.S.C. 154(b) by 121 days.

(21) Appl. No.: 11/232,268

(22) Filed: Sep. 20, 2005

(65) Prior Publication Data

US 2007/0066504 A1 Mar. 22, 2007

(51) Int. Cl.
*C11D 1/72* (2006.01)
*C11D 3/20* (2006.01)
*C11D 9/26* (2006.01)

(52) U.S. Cl. ..... 510/360; 510/340; 510/353; 510/356; 510/421; 510/426; 510/505

(58) Field of Classification Search ..... 510/340, 510/353, 356, 360, 421, 426, 505
See application file for complete search history.

(56) References Cited

U.S. PATENT DOCUMENTS

| | | | | |
|---|---|---|---|---|
| 3,231,505 | A | 1/1966 | Farrar et al. | 252/138 |
| 3,232,506 | A | 2/1966 | Rabinow | 225/93 |
| 3,884,946 | A | 5/1975 | Sung et al. | 260/400 |
| 4,343,726 | A | 8/1982 | Egan et al. | 252/547 |
| 5,279,313 | A | 1/1994 | Clausen et al. | 132/208 |
| 5,382,375 | A | 1/1995 | You et al. | 252/117 |
| 5,753,606 | A | 5/1998 | Hees et al. | 510/422 |
| 5,854,201 | A | 12/1998 | Behler et al. | 510/515 |
| 6,071,873 | A | 6/2000 | Mertens | 510/417 |
| 6,107,268 | A | 8/2000 | Yahiaoui et al. | 510/438 |
| 6,300,508 | B1 | 10/2001 | Raths et al. | 554/149 |
| 6,316,401 | B1 | 11/2001 | Mertens | 510/417 |
| 6,319,887 | B1 | 11/2001 | Mertens | 510/417 |
| 6,384,009 | B1 * | 5/2002 | Koester et al. | 510/421 |
| 6,395,694 | B1 | 5/2002 | Littau | 510/276 |
| 6,417,146 | B1 | 7/2002 | Miyajima et al. | 510/130 |
| 6,448,214 | B1 * | 9/2002 | Del Duca et al. | 510/372 |
| 2002/0042352 | A1 | 4/2002 | Yahiaoui et al. | 510/175 |
| 2004/0162229 | A1 * | 8/2004 | Arai | 510/421 |

FOREIGN PATENT DOCUMENTS

| | | |
|---|---|---|
| DE | 195 02 454 | 8/1996 |
| EP | 913 458 | 5/1999 |
| EP | 10 92 761 | 2/2004 |
| GB | 1 465 700 | 2/1977 |
| GB | 1 546 829 | 5/1979 |
| GB | 2 141 965 | 1/1985 |
| JP | 50 119812 | 9/1975 |
| JP | 8 157897 | 6/1996 |
| JP | 8 209193 | 8/1996 |
| JP | 9 78092 | 3/1997 |
| JP | 9 104895 | 4/1997 |
| JP | 3410880 | 3/2003 |
| WO | 94/13618 | 6/1994 |
| WO | 96/23049 | 8/1996 |
| WO | 96/29389 | 9/1996 |
| WO | 97/06125 | 2/1997 |
| WO | 00/31221 | 6/2000 |
| WO | 01/10391 | 2/2001 |
| WO | 01/10403 | 2/2001 |
| WO | 01/74981 | 10/2001 |

OTHER PUBLICATIONS

Co-pending application: Applicant: Hsu et al., U.S. Appl. No. 11/050,928, filed Feb. 4, 2005.
Derwent Abstract of WO 96/23049 published Aug. 1, 1996.
Derwent Abstract of WO 01/10391 published Feb. 15, 2001.
Derwent Abstract of WO 94/13618 published Jun. 23, 1994.
Derwent Abstract of JP 90 78092 published Mar. 25, 1997.
Derwent Abstract of JP 91 04895 published Apr. 22, 1997.
Derwent Abstract of JP 8 157897 published Jun. 18, 1996.
Derwent Abstract of JP 82 09193 published Aug. 13, 1996.
Derwent Abstract of JP 34 10880 published May 26, 2003.
Derwent abstract of WO 01/10403 published Jan. 4, 2001.
Derwent Abstract of WO 01/74981—published Oct. 11, 2001.
"*Group Selectivity of Ethoxylation of Hydroxy Acids*", by A.J. O'Lenick, Jr., www.zenitech.com/documents/castor-oul.pdf.
Journal of Surfactants and Detergent, "*Synthesis and Chemical Hydrolysis of Surface-Active Esters*", M. Stjerndahl and Holmberg, vol. 6, No. 4 (Oct. 2003), pp. 311-318.
PCT International Search Report in a PCT application PCT/EP2005/005753.
Derwent Abstract of DE 195 02 454—published Aug. 1, 1996.
Derwent Abstract of JP 50 119812—published Sep. 19, 1975.
Derwent Abstract of WO 96/29389—published Sep. 26, 1996.
Derwent Abstract of WO 96/23049—published Aug. 1, 1196.

* cited by examiner

*Primary Examiner*—Brian Mruk
(74) *Attorney, Agent, or Firm*—Rimma Mitelman

(57) ABSTRACT

An aqueous liquid laundry detergent composition comprising an alkoxylated carboxylic acid surfcatant and a free radical scavenger in the mole ratio of from about 500:1 to about 20:1. The composition substantially prevents the degradation of the alkoxylated ester surfactant upon storage and is also color-stable.

9 Claims, No Drawings

LIQUID LAUNDRY DETERGENT WITH AN ALKOXYLATED ESTER SURFACTANT

FIELD OF THE INVENTION

The present invention relates to liquid aqueous laundry detergent compositions comprising alkoxylated carboxylic acid ester surfactants in combination with free radical scavengers.

BACKGROUND OF THE INVENTION

Liquid laundry detergents are popular with the consumers. While a variety of surfactants is available to manufacturers to formulate these, it is desirable to include alkoxylated ester surfactants, due to its better biodegradability in comparison to alcohol-based alkoxylates. In addition, alkoxylated ester surfactants are derived from a renewable source—oil and fat. Unfortunately, alkoxylated ester surfactants hydrolyse in the presence of water, and especially under alkaline conditions. The hydrolysis has a dual disadvantage of destroying the surfactant and introducing fatty acid, one of the degradation products, which is, essentially, oily soil. The hydrolysis of acid esters occurs in an aqueous, high pH environment, and so may occur in the bottled compositions on storage (most laundry compositions are aqueous and have pH of 6-10).

The following art describes compositions, in some instances laundry compositions, that may include various, broadly ranging carboxylic acid esters and/or alkoxylated derivatives thereof: Koester et al. (U.S. Pat. No. 6,384,009), Hees et al. (U.S. Pat. No. 5,753,606), WO 01/10391, WO 96/23049, WO 94/13618, Miyajima et al. (U.S. Pat. No. 6,417,146), JP 9078092, JP 9104895, JP 8157897, JP 8209193 and JP 3410880.

Laundry compositions containing free radical scavengers are described in U.S. Pat. No. 6,448,214.

SUMMARY OF THE INVENTION

The present invention includes an aqueous liquid laundry detergent composition comprising:

(a) from about 5% to about 80%, by weight of the composition, of a detergent surfactant, wherein from about 1% to about 80%, by weight of the composition is an alkoxylated carboxylic acid ester surfactant of formula (I):

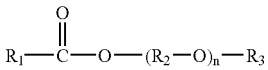

wherein $R_1$ is selected from linear or branched $C_6$ to $C_{22}$ alkyl or alkylene groups;

$R_2$ is selected from $C_2H_4$ or $C_3H_6$ groups;

$R_3$ is selected from H, $CH_3$, $C_2H_5$ or $C_3H_7$ groups;

and n has a value between 1 and 20, (b) a free radical scavenger;

(c) wherein the mole ratio of the ester to the free radical scavenger is from about 500:1 to about 20:1;

(d) a laundry detergent ingredient selected from the group consisting of an enzyme, a fluorescing agent, a soil suspending agent, an anti-redeposition polymer and mixtures thereof;

(e) from about 15% to about 90% of water.

The invention also includes an aqueous wash liquor resulting from the use of the composition in laundering fabrics, the wash liquor comprising the alkoxylated ester surfactant and the free radical scavenger.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is used herein in its ordinary meaning and is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

Alkoxylated Carboxylic Acid Esters (also sometimes referred to herein as "alkoxylated esters") included in the present invention have Formula (I) as follows:

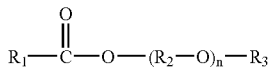

Where $R_1$ is selected from linear or branched $C_6$ to $C_{22}$ alkyl or alkylene groups;

$R_2$ are selected from $C_2H_4$ or $C_3H_6$ groups;

$R_3$ are selected from H, $CH_3$, $C_2H_5$ or $C_3H_7$ groups;

and n has a value between 1 and 20.

Preferably, R1 is selected from $C_{12}$ to $C_{18}$,

R2 is $C_2H_4$,

R3 is selected from $CH_3$ and $C_2H_5$, and n is a value between 3 and 15, most preferably from 5 to 12.

The preferred compounds of formula (I) in the inventive compositions are selected from alkoxylated derivatives derived from coconut, palm, palm kernel, palm stearin, tallow, soybean and rapeseed oil due to their availability.

Carboxylic acid esters are available commercially or may be prepared by the alcoholysis of glycerides, preferrably from natural oil or fat, and the esterification of carboxylic acid with alcohol, e.g. methanol or ethanol, to form carboxylic acid ester; the alkoxylated derivatives may be obtained by the alkoxylation of carboxylic acid ester with alkylene oxide with the presence of catalyst. Carboxylic acid esters are also widely available as "bio-diesel". Twin River Technologies provides various types of carboxylic acid esters. Huntsman provides various alkoxylated carboxylic methyl esters.

The amount of the alkoxylated derivative of ester employed in the inventive compositions is in the range of from 1% to 80%, preferably from 2% to 50%, most preferably from 3% to 20%, optimally from 4% to 15%, by weight of the composition. The concentration of alkoxylated esters in an aqueous wash liquor preferably in the range of from 1 ppm to 1000 ppm.

Generally, the amount of the alkoxylated ester surfactant in the inventive compositions is substantially the same upon storage, due to the ability of the free radical scavenger to preserve this surfactant. Preferably, the stability upon storage of the inventive compositions is that at least 70%, preferably at least 80%, most preferably at least 90% of the originally formulated amount of the alkoxylated ester surfactant, is still present in the composition upon storage at 40° C. for 3 months.

Surfactant

The overall amount of surfactant in the inventive compositions is generally in the range of from 5 to 80%, preferably from 10 to 60%, most preferably from 15 to 30%. The alkoxylated ester of the present invention is a nonionic surfactant. Thus, the alkoxylated ester may be the sole surfactant in the composition, or may be co-present with other surfactants. Preferably the alkoxylated ester surfactant is included in the inventive compositions in combination with anionic, cationic and amphoteric surfactant, most preferably anionic surfactant. The preferred ratio of alkoxylated ester surfactant to the sum of other surfactants is between 5:1 to 1:5, and more preferably between 3:1 to 1:3. Furthermore, it is to be understood that any surfactant described below may be used in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water soluble group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl sulfonates, alkyl sulfonates, alkyl sulfates and the alkyl polyether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The anionic surfactant is present in an amount of from 0 to 70%, preferably at least 5%, generally from 5 to 50%, more preferably from 5 to 20%.

Additional Nonionic Surfactant

Nonionic surfactants in addition to the alkoxylated ester surfactants may be included. As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, wit about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$-$C_{15}$ fatty alcohol condensed with 6 moles ethylene oxide and 3 moles propylene oxide, $C_{13}$-$C_{15}$ fatty alcohol condensed with 7 moles propylene oxide and 4 moles ethylene oxide, $C_{13}$-$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$-$C_{11}$ fatty alcohol with an average of 5 moles ethylene oxide and Dobanol® 25-7 is an ethoxylated $C_{12}$-$C_{15}$ fatty alcohol with an average of 7 moles ethylene oxide per mole of fatty alcohol.

In the compositions of this invention, preferred nonionic surfactants include the $C_{12}$-$C_{15}$ primary fatty alcohols with relatively narrow contents of ethylene oxide in the range of from about 6 to 9 moles, and the $C_9$ to $C_{11}$ fatty alcohols ethoxylated with about 5-6 moles ethylene oxide.

Another class of nonionic surfactants which can be used in accordance with this invention are glycoside surfactants. Glycoside surfactants suitable for use in accordance with the present invention include those of the formula:

$$RO—(R^2O)_y—(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Mixtures of two or more of the nonionic surfactants can be used.

Generally, nonionics (other than alkoxylated esters required by the present invention) would comprise 0-75%, preferably 2 to 50%, more preferably 0 to 15%, most preferably 0 to 10%. The level of nonionic surfactant may be lowered compared to the typical compositions, due to the unexpected advantage of the esters/alkoxylated derivatives in the inventive compositions contribution to the oily soil removal.

Preferred inventive compositions comprise both anionic and nonionc surfactants, typically in a weight ratio of from 1:4 to 4:1.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-soluble group, e.g., carboxy, sulfonate, sulfate, phosphate, or phosphonate.

Specific examples of zwitterionic surfactants which may be used are set forth in U.S. Pat. No. 4,062,647, hereby incorporated by reference.

Free Radical Scavenger

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anisole (BHA), benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene.

The amounts of free radical scavenger in the inventive compositions are important. If too low an amount is employed, relative to the amount of the alkoxylated ester, then of course the hydrolysis of the ester still occurs. If too high an amount is included, relative to the amount of the alkoxylated ester, then the free radical scavenger is oxidised; the presence of substantial amounts of greater than 0.2% of free radical scavenger in a composition results in yellowing of the composition, due to increased amounts of oxidised free radical scavenger. According to the present invention, the mole ratio of the alkoxylated ester to the free radical scavenger is in the range from 500:1 to 20:1, preferably from 250:1 to 30:1, most preferably from 200:1 to 50:1.

Generally, the amount of free radical scavenger in the inventive composition is at most 0.2%, preferably at most 0.1%, most preferably at most 0.05%, in order to optimise preservation of the alkoxylated ester surfactant, while avoiding the yellowing of the composition. During the wash, the aqueous laundry wash liquor preferably contains from about from about 0.01 ppm to about 12 ppm of free radical scavenger in order to ensure the protection of ester surfactants.

Oxidised Free Radical Scavenger

Oxidized free radical scavenger produces off-color, e.g. yellowing of the inventive composition. The most common free radical scavenger has a pheno structure, e.g. B.H.T. After oxidation, the pheno type if structure is oxidized and converted in a quinone type of structure—generally, quinones cause the yellowing of the composition.

The generation of oxidized free radical scavenger also means that the scavenging capacity of free radical is reduced. Because free radical scavengers will be naturally oxidized even without the presence of free radicals, the amount of oxidised free radical scavenger in a composition is limited to at most 0.2%, preferably at most 0.1%, most preferably at most 0.05%.

The inventive composition preferably have color stability (they remain clear, without yellowing) of at least 1 month, preferably at least 3 months on storage at 40° C.

Water

The inventive compositions are aqueous. The inventive compositions comprise generally from 15% to 90%, preferably from 30% to 80%, most preferably, to achieve optimum cost and ease of manufacturing, from 50% to 70% of water. Other liquid components, such as solvents, surfactants, liquid organic matters including organic bases, and their mixtures can be co-present.

Solvents that may be present include but are not limited to alcohols, surfactant, fatty alcohol ethoxylated sulfate or surfactant mixes, alkanol amine, polyamine, other polar or non-polar solvents, and mixtures thereof.

pH

The pH of the inventive compositions is generally in the range of from 6 to 9.5, preferably of 6.5 to 9 and most preferably of 7 to 8.5. Surprisingly, even at this alkaline pH and even in the presence of substantial amounts of water, the alkoxylated ester nonionic surfactant does not substantially degrade in the inventive compositions, by virtue of the inclusion of the free radical scavenger.

Additional Laundry Ingredients

The inventive compositions may include additional carboxylic acid esters and/or alkoxylated derivatives thereof, in addition to alkoxylated esters already included in the present invention.

The inventive compositions include an additional laundry ingredient selected from the group consisting of enzyme, fluorescent agent, soil release polymer, anti-redeposition polymer and mixtures thereof. These are described in greater detail below. Additional laundry ingredients described below are optional.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., odium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $(NaAlO_2)_x.(SiO_2)_y$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may be used in the compositions of the invention.

If a lipase is used, it has to be isolated from the alkoxylated ester surfactant in the inventive compositions, either by encapsulation or in separate compartments due to the ability of lipase to decompose esters. The lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. *lipolyticum* NRRL B-3673.

An example of a fungal lipase as defined above is the lipase ex *Humicola lanuginosa*, available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1-10, more preferably 0.5-7, most preferably 1-2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05-50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way to a specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application. A pH jump heavy duty liquid is a composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Alkalinity buffers which may be added to the compositions of the invention include monoethanolamine, triethanolamine, borax and the like.

The inventive compositions preferably include from 0.01% to 2.0%, more preferably from 0.05% to 1.0%, most preferably from 0.05% to 0.5% of a fluorescer. Examples of suitable fluorescers include but are not limited to derivative of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Preferably, the detergent composition is a colored composition packaged in the transparent/translucent ("see-through") container.

Process of Making

The inventive compositions may be prepared by any method known to one of ordinary skill in the art. Surfactants, including the alkoxylated ester surfactant are pre-mixed. The rest of the ingredients, if any, such as, whitening agent, functional polymers, perfume, enzyme, colorant, preservatives are then mixed to obtain an isotropic liquid. In general, the alkoxylated ester surfactant is preferably not contacted with a strong base, e.g. NaOH, to prevent the degradation of the surfactant. If the contact between the alkoxylated ester surfactant and a strong base is necessary, then the contact time should be kept as short as possible.

Container

Preferred containers are transparent/translucent bottles. "Transparent" as used herein includes both transparent and translucent and means that a composition, or a package according to the invention preferably has a transmittance of more than 25%, more preferably more than 30%, most preferably more than 40%, optimally more than 50% in the visible part of the spectrum (approx. 410-800 nm). Alternatively, absorbency may be measured as less than 0.6 (approximately equivalent to 25% transmitting) or by having transmittance greater than 25% wherein % transmittance equals: $1/10^{absorbancy} \times 100\%$. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic co-polymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of Using Compositions

In use, the indicated quantity of the composition (generally in the range from 50 to 200 ml) depending on the size of the laundry load, the size and type of the washing machine, is added to the washing machine which also contains water and the soiled laundry. The inventive compositions are particularly suited for use with front-loading washing machine, due to the ability of the inventive compositions to deliver high performance with low foaming—front-loading machines require low foaming compositions.

The following specific examples further illustrate the invention, but the invention is not limited thereto.

The following abbreviations and/or tradenames were used in the Examples:

MEE: 9-EO Methyl ester ethoxylate of coco fatty acid
LAS acid: lineal alkylbenzenesulfonic acid
NA-LAS: sodium linealalkylbenzenesulfonate
Neodol 25-9: 9 EO ethoxylated fatty alcohol
BHT: Butylated hydroxytuluene
TEA: triethanolamine
SLES: sodium alcohol ethoxylate sulfate
MPEG (a degradation product of MEE, in addition to the fatty acid): methyl ester polyethylene glycol Detergency Evaluation:

Evaluation for detergency was conducted at 32.5° C. A benchmark detergent was also tested for the purpose of comparison. The detergency test clothes AS10 and PC9, which are the test clothes of protein and oil particulate on cotton and oily particulate on 65% polyester/35% cotton blend, respectively, were used in evaluating the detergency. A Hunter color spectrophotometer was used to measure R Index values, which is based on "Rdab scale" theory developed by Hunter. The detergency, % D, is calculated using the following equation:

$$\% D = 100 * \delta R_d / (90 - R_{initial})$$

Wherein $\delta R_d = R_{final} - R_{initial}$

The higher the % D value, the better the cleaning.

EXAMPLE 1 AND COMPARATIVE EXAMPLE A

Example 1 (within the scope of the present invention) and Comparative Example A (outside the scope of the present invention) demonstrated the effect of free radical scavenger in slowing down the hydrolysis speed of the MEE relative to Comparative Example A. Water and Borax were added to the main mix to form a clear solution, Premix 1 was prepared for Example 1 by dissolving BHT in MEE., followed by the addition of MEE for Comparative Example A and Premix 1 for Example 1 to the main mix. At last the preservative Kathon was added. The final pH values of the batches were about 9.27. The pH values after 3 month storage at 52° C. were listed in Table 1.

TABLE 1

| Ingredients | Examples A % | Examples 1 % |
|---|---|---|
| MEE | 10.00 | 10.00 |
| BHT | 0.00 | 0.10 |
| Borax | 1.00 | 1.00 |
| Misc | 0.5 | 0.5 |
| Water | To 100 | To 100 |
| pH (after making) | 9.27 | 9.27 |
| Molar ratio of MEE/BHT | | 32:1 |
| stored for 3 months at 52° C. | | |
| pH | 7.37 | 8.15 |
| MEE remaining* | 6.42 | 9.78 |
| MEE loss* | 3.58 | 0.22 |
| Fatty acid created* | 1.31 | 0.08 |
| MPEG created* | 2.62 | 0.15 |
| % Loss of MEE based on MEE | 35.8% | 2.2% |

*calculated

As can be seen from the results in Table 1, the addition of 0.10% of BHT, equivalent to BHT:MEE molar ratio of 32:1, slowed down the hydrolysis of MEE. In sample A without BHT, pH went down by 1.8 (from 9.27 to 7.37); MEE reduced by 3.58% (from 10.00% to 6.42%); and by-products Fatty acid and MPEG generated in amounts of 1.31% and 2.62%, respectively.

EXAMPLE 2 AND COMPARATIVE EXAMPLES B, C AND D

Example 2 (within the scope of the present invention) and Comparative Examples B-D (outside the scope of present invention) in Table 2 were prepared by following the procedure: Premix 1 was prepared by mixing nonionic surfactant and BHT and/or MPEG at 40° C. to form a clear liquid. Followed by mixing LAS acid and fatty acid to form Premix 2. Water, 50% NaOH, borax, TEA, and citric acid were then added to the main mix to form a clear solution. Followed by the addition of Premix 2. After the neutralization, SLES was added and followed by the addition of Premix 1. The rest of the ingredients, such as fluorescer, functional polymers, perfume, enzyme, colorant, preservatives were added at the last stage and mixed until the batch became an isotropic liquid.

MPEG and fatty acid were added to comparative Examples B-D to simulate the product containing degraded MEE, these examples are analogous to Example A, which resulted on actual storage. The results that were obtained are summarised in Table 2.

TABLE 2

| ingredients | Examples 2 % | B % | C % | D % |
|---|---|---|---|---|
| LAS | 4.98 | 4.98 | 4.98 | 4.98 |
| SLES | 8.20 | 8.20 | 8.20 | 8.20 |
| MEE | 8.00 | 6.00 | 5.00 | 4.00 |
| BHT | 0.1 | 0 | 0 | 0 |
| MPEG | 0.00 | 1.33 | 2.00 | 2.67 |
| Coco fatty acid | 0.00 | 0.67 | 1.00 | 1.33 |
| Citric acid | 1.96 | 1.96 | 1.96 | 1.96 |
| TEA | 1.00 | 1.00 | 1.00 | 1.00 |
| Miscellaneous | 0.50 | 0.50 | 0.50 | 0.50 |
| Water | To 100 | To 100 | To 100 | To 100 |
| pH | 8.06 | 8.00 | 8.03 | 8.05 |

TABLE 2-continued

| ingredients | Examples 2 % | B % | C % | D % |
|---|---|---|---|---|
| Molar ratio of MEE/BHT (added) | 25:1 | | | |
| Viscosity (mPas.) | 158 | 90 | 65 | 51 |
| MEE + MPEG + Coco fatty acid | 8.00 | 8.00 | 8.00 | 8.00 |
| % D of detergency cloth | | | | |
| AS10 | 21.54 | 20.18 | 19.79 | 19.38 |
| PC9 | 36.02 | 33.72 | 33.69 | 32.51 |

Comparative Examples B, C and D in Table 2 show the formulations, which were equivalent to the compositions without a radial scavenger after various periods of storage (i.e., Example A). MEE in these formulations was hydrolyzed and generated MPEG and fatty acid. Their detergency performance dropped considerably as shown on the detergency of AS10 and PC9 test clothes.

EXAMPLE 3 AND COMPARABLE EXAMPLES E AND F

Example 3 illustrates the criticality of mole ratio of the alkoxylated ester surfactant to the free radical scavanger. Example 3 (within the scope of the present invention) and Comparative Examples E and F (outside the scope of present invention) in Table 3 were prepared by following the procedure described in Example 1. The results that were obtained are summarised in Table 3.

TABLE 3

| Ingredient | Example 3 % | E % | F % |
|---|---|---|---|
| MEE | 10 | 10 | 10 |
| Borax | 1 | 1 | 1 |
| BHT | 0.1 | 0.5 | 1.0 |
| Water and Misc. | To 100 | To 100 | To 100 |
| MEE:BHT; mole ratio | 36 | 7.2 | 3.6 |
| Color of the composition | | | |
| Freshly Prepared | clear | clear | clear |
| After 1 month storage @ 25° C. | clear | Yellow | Yellow |

As shown in Table 3, Example 3, with BHT level of 0.1 and MEE to BHT ratio of 36:1 has shown the color stability after one month of storage at room temperature. On the other hand, the comparative examples E and F, which have BHT level higher than 0.2 and MEE:BHT less than 20, have turned to yellow under the same storage condition.

What is claimed is:

1. An aqueous liquid laundry detergent composition comprising:

(a) from about 5% to about 80%, by weight of the composition, of a detergent surfactant, wherein from about 1% to about 80%, by weight of the composition is an alkoxylated carboxylic acid ester surfactant of formula (I):

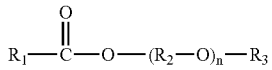

wherein $R_1$ is selected from linear or branched $C_6$ to $C_{22}$ alkyl or alkylene groups;

$R_2$ is selected from $C_2H_4$ or $C_3H_6$ groups;

$R_3$ is selected from $CH_3$, $C_2H_5$ or $C_3H_7$ groups;

and n has a value between 1 and 20, (b) a free radical scavenger;

(c) wherein the mole ratio of the ester to the free radical scavenger is from about 500:1 to about 20:1;

(d) a laundry detergent ingredient selected from the group consisting of an enzyme, a fluorescing agent, a soil suspending agent, an anti-redeposition polymer and mixtures thereof;

(e) from about 15% to about 90% of water.

2. The composition of claim 1 wherein the composition comprises an oxidised free radical scavenger.

3. The composition of claim 2 wherein the maximum amount of the oxidised free radical scavenger is about 0.20% by weight of the composition.

4. The composition of claim 1 wherein the maximum amount of the free radical scavenger is about 0.2% by weight of the composition.

5. The composition of claim 1 wherein the ratio is from about 250:1 to about 20:1.

6. The composition of claim 1 wherein the pH of the composition is in the range of from about 6 to about 9.5.

7. The composition of claim 1, wherein at least 70% of the alkoxylated ester surfactant is still present in the composition upon storage at 40° C. for 3 months.

8. The composition of claim 1, wherein the composition remains clear, without yellowing, for at least 1 month on storage at 40° C.

9. An aqueous laundry wash liquor comprising (a) from about 1 ppm to about 1000 ppm of an alkoxylated carboxylic acid ester of formula (I):

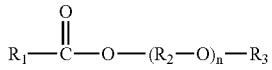

wherein $R_1$ is selected from linear or branched $C_6$ to $C_{20}$ alkyl or alkylene groups;

$R_2$ is selected from $C_2H_4$ or $C_3H_6$ groups;

$R_3$ is selected from $CH_3$, $C_2H_5$ or $C_3H_7$ groups;

and n has a value between 1 and 20, (b) from about 0.01 ppm to about 12 ppm free radical scavenger.

* * * * *